US006439424B1

(12) United States Patent
Threadgill, Jr.

(10) Patent No.: US 6,439,424 B1
(45) Date of Patent: Aug. 27, 2002

(54) PORTABLE GOLF BALL STORAGE, DISPENSING AND DISPLAY APPARATUS

(76) Inventor: Robert E. Threadgill, Jr., P.O. Box 695, Wimberley, TX (US) 78676

( * ) Notice: Subject to any disclaimer, the term of this patent is extended or adjusted under 35 U.S.C. 154(b) by 89 days.

(21) Appl. No.: 09/761,231

(22) Filed: Jan. 16, 2001

(51) Int. Cl.[7] ..... A01C 1/08
(52) U.S. Cl. ..... 221/185; 224/274
(58) Field of Search ..... 221/185, 303, 221/306, 310; 224/274, 919; 294/19.1, 19.2

(56) References Cited

U.S. PATENT DOCUMENTS 4,058,336 A 11/1977 Parkinson
4,491,221 A 1/1985 Lange
4,629,235 A 12/1986 Logue
4,678,108 A 7/1987 Inman
4,840,332 A 6/1989 Hoyt
5,060,996 A 10/1991 Garnes
5,620,378 A 4/1997 Fritz et al.
5,715,947 A 2/1998 Gonzales
5,839,607 A 11/1998 Swanson

*Primary Examiner*—Kenneth W. Noland
(74) *Attorney, Agent, or Firm*—John D. Gugliotta

(57) ABSTRACT

A portable golf ball storage, dispensing and display apparatus is provided having a linearly elongated tubular housing, a mounting bracket, and a housing alignment support. The tubular housing is constructed of a rigid, transparent plastic material and has a uniform diameter which is slightly larger than a diameter of a golf ball. The tubular housing is designed and configured for storing approximately twelve golf balls in a vertically aligned series. The tubular housing further includes a removably securable top cap designed so as to be securely maintained within an anterior end of the tubular housing.

15 Claims, 5 Drawing Sheets

PORTABLE GOLF BALL STORAGE, DISPENSING AND DISPLAY APPARATUS

RELATED APPLICATIONS

The present invention was first described in Disclosure Document No. 479,335 filed on Sep. 5, 2000. There are no previously filed, nor currently any co-pending applications, anywhere in the world.

BACKGROUND OF THE INVENTION

1. Field of the Invention

The present invention relates generally to golf ball retaining and dispensing devices and, more particularly, a portable golf ball storage, dispensing and display apparatus.

2. Description of the Related Art

Golfing is a sport enjoyed and played by many. It provides unique experiences and challenges with each game. It is commonplace for a golfer to use a considerable number of balls both during practice sessions and during a typical 18 hole round of golf. Thus, a golfer is required to carry a substantial number of golf balls. However, this poses not only a problem of sorting out practically new balls from scuffed or cut balls, but also presents the problem of storage and easy access of the balls during the game. Many golfers will simply buy a new sleeve of balls simply to avoid picking through scuffed or cut balls. In addition, most golfers store their golf balls in the tray of the golf cart which typically contains paper cups, dirt and cigarette wrappers.

Furthermore, along with golfs unique experiences and challenges, many memories are created such as playing on famous courses, achieving a hole in one, tournament winning golf balls, and the like. These experiences are typically memorialized through the collection of golf balls which signify such accomplishments and outings.

Accordingly, there is a need for a means by which golfers can not only store and easily access golf balls during practice or during a round of golf, but also a means by which golf balls can be displayed as a wall-mounted plaque in a quick, easy, and efficient manner. The development of the portable golf ball storage, dispensing and display apparatus fulfills this need.

A search of the prior art did not disclose any patents that read directly on the claims of the instant invention; however, the following references were considered related. The following patents disclose a golf ball tubular shagging and carrying device: U.S. Pat. No. 5,060,996 issued in the name of Games; U.S. Pat. No. 4,629,235 issued in the name of Logue; and U.S. Pat. No. 4,058,336 issued in the name of Parkinson.

The following patents describe a golf ball tubular holder and carrier: U.S. Pat. No. 4,840,332 issued in the name of Hoyt; and U.S. Pat. No. 4,678,108 issued in the name of Inman.

U.S. Pat. No. 5,839,607 issued in the name of Swanson discloses a golf ball tubular storing and dispensing device.

U.S. Pat. No. 5,715,947 issued in the name of Gonzales describes a display case for storing and displaying golf balls.

U.S. Pat. No. 5,620,378 issued in the name of Fritz et a. discloses a golf club with integral ball storage.

U.S. Pat. No. 4,491,221 issued in the name of Lange describes a convertible golf ball carrying container.

Consequently, a need has been felt for providing a device which not only allows golf balls to be stored and easily accessed during practice or during a round of golf, but which can also be displayed as a wall-mounted plaque in a quick, easy, and efficient manner.

SUMMARY OF THE INVENTION

Therefore, it is an object of the present invention to provide a tubular housing for storing and singly dispensing golf balls therefrom.

It is another object of the present invention to provide a tubular housing constructed of transparent acrylic.

It is another object of the present invention to provide a tubular housing which stores a plurality of golf balls in a vertically aligned series.

It is another object of the present invention to provide a tubular housing which stores approximately 12 golf balls.

It is another object of the present invention to provide a dispensing opening for allowing access to the stored golf balls.

It is another object of the present invention to provide a tubular housing with a restraining lip for restraining free transverse movement of the lowermost, serially aligned golf ball.

It is another object of the present invention to provide a tubular housing which is removably mounted to a golf cart roof support member.

It is another object of the present invention to provide a tubular housing adapted so as to be mounted to a golf cart roof or hand-pulled golf cart.

It is another object of the present invention to provide a tubular housing which includes a top cap.

It is another object of the present invention to provide a tubular housing with a top cap which can be secured to the tubular housing.

It is another object of the present invention to provide a mounting bracket for mounting the tubular housing to the golf cart roof support member.

It is another object of the present invention to provide a housing alignment support for aiding in maintaining proper linear alignment of the tubular housing.

Briefly described according to one embodiment of the present invention, a portable golf ball storage, dispensing and display apparatus is comprised of a linearly elongated tubular housing, a mounting bracket, and a housing alignment support. The tubular housing is preferably constructed of a rigid, transparent plastic material such as acrylic, and has a uniform diameter which is slightly larger than a diameter of a golf ball. The tubular housing is designed and configured for storing approximately twelve golf balls in a vertically aligned series. The tubular housing further includes a removably securable top cap designed so as to be securely maintained within an anterior end of the tubular housing.

A lower, front portion of the tubular housing is formed to define a dispensing opening, wherein a lower extremity thereof is formed of an upstanding arcuate-shaped restraining lip for restraining transverse movement of a lowermost serially aligned golf ball within an internal chamber of the tubular housing.

A mounting bracket is provided for mounting the tubular housing to a golf cart roof support member. An integral housing alignment support located along a lower portion of an outer sidewall structure of the tubular housing, below the mounting bracket, is provided for aiding in maintaining proper linear alignment of the tubular housing.

The use of the present invention allows golf balls to be stored and easily accessed during practice or during a round of golf, and can also be displayed as a wall-mounted plaque in a quick, easy, and efficient manner.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENT

1. Detailed Description of the Figures

Figure 1:
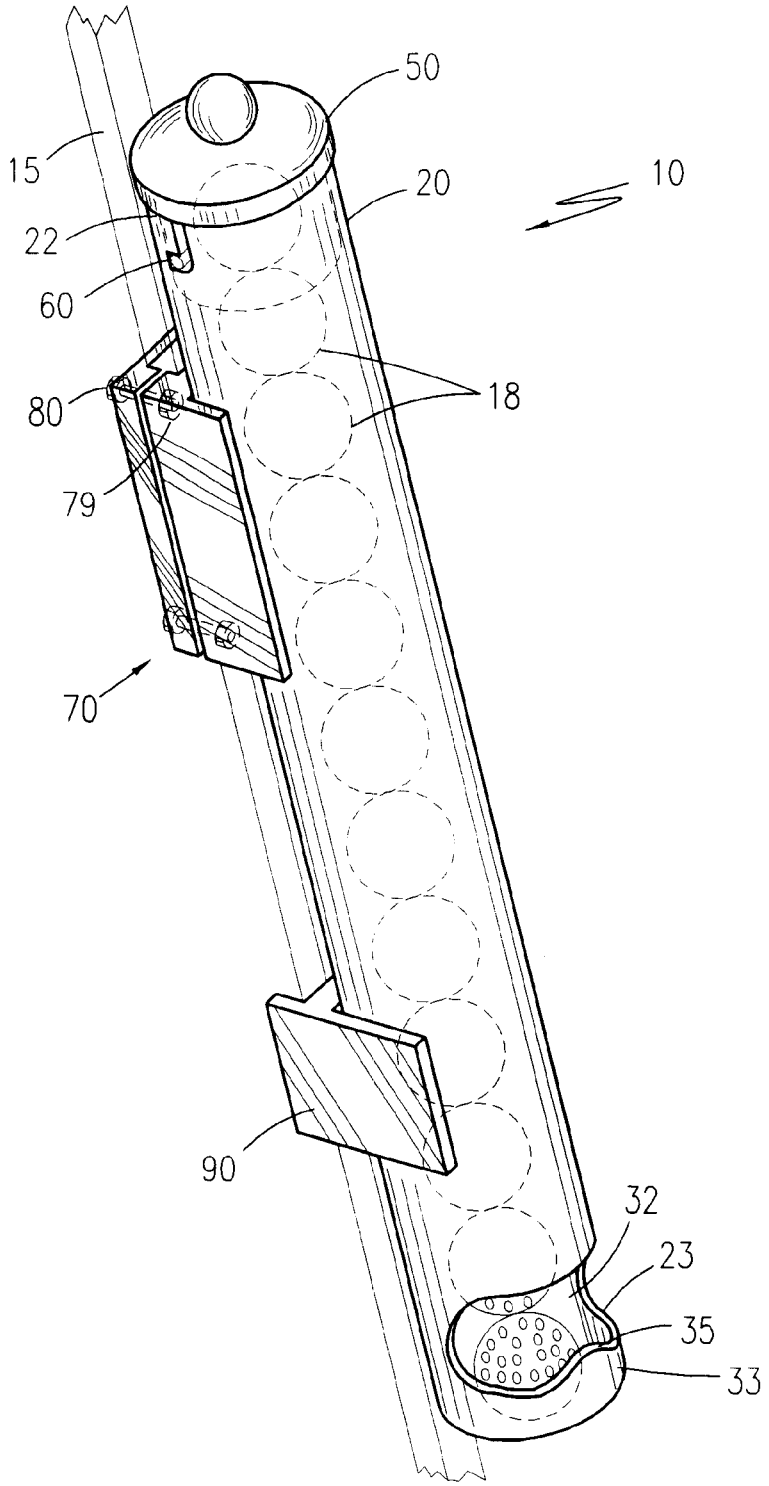
FIG. 1 is a perspective view of a portable golf ball storage, dispensing and display apparatus according to the preferred embodiment of the present invention.

Referring now to FIGS. 1–6, a portable golf ball storage, dispensing and display apparatus 10 is shown, according to the present invention, comprised of a linearly elongated tubular housing 20, a mounting bracket 70, and a housing alignment support 90.

The tubular housing 20 is preferably constructed of a rigid, transparent plastic material such as acrylic, and has a uniform diameter which is slightly larger than a diameter of a golf ball 18. It is envisioned that the tubular housing 20 may be constructed of wood or other suitable material. The tubular housing 20 is further defined as having an anterior end 22 opposite a posterior end 23, wherein a portion of the tubular housing 20 above the posterior end 23 is curved slightly inward. The tubular housing 20 includes an outer side wall structure 21 and an internal chamber 25. A plurality of golf balls 18 are vertically aligned in series within the internal chamber 25 of the tubular housing 20. It is envisioned that the tubular housing 20 is of a length suitable for storing up to twelve golf balls 18.

A lower, front portion of the tubular housing 20 is formed to define a dispensing opening 32, wherein a lower extremity 33 thereof is formed of an upstanding arcuate-shaped restraining lip 35 for restraining transverse movement of a lowermost serially aligned golf ball 18 within the internal chamber 25.

Figure 2:
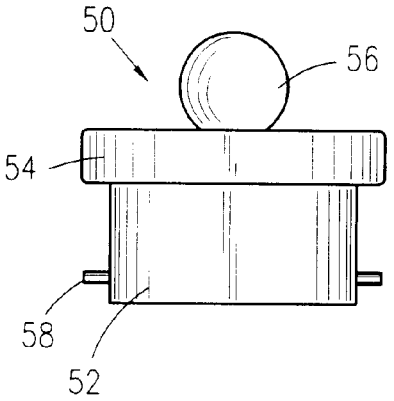
FIG. 2 is a side elevational view of the top cap according to the preferred embodiment of the present invention.
Figure 3:
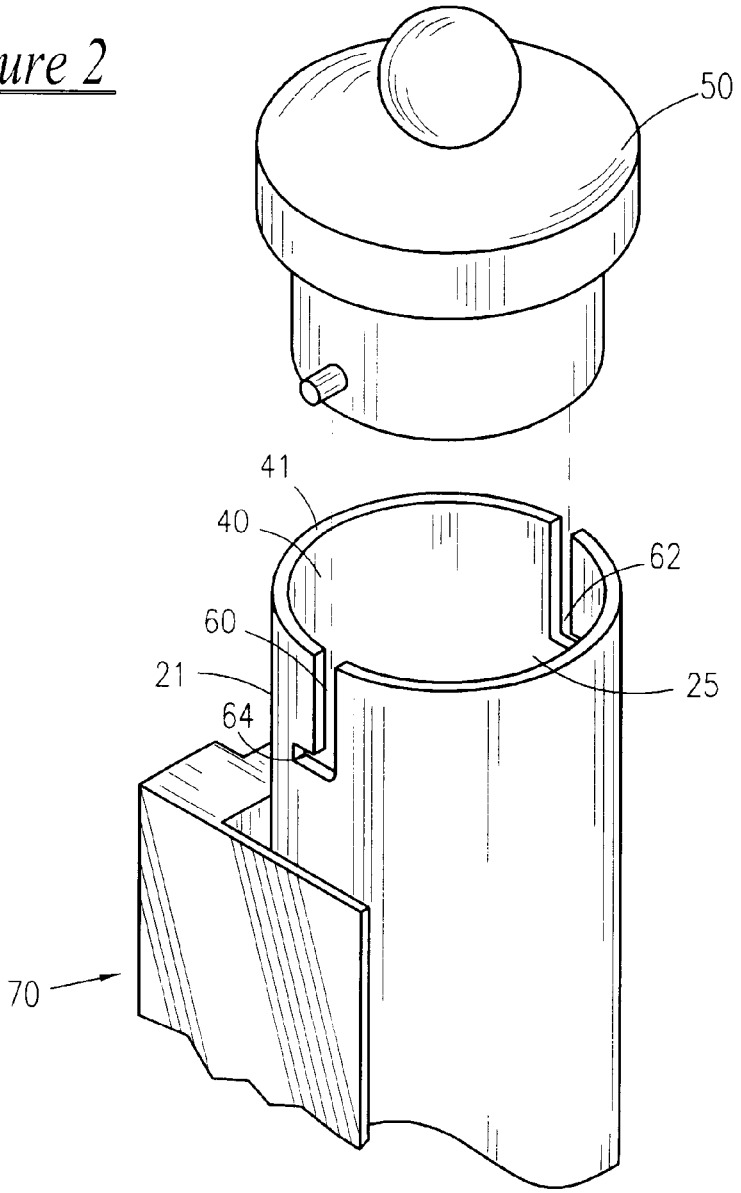
FIG. 3 is an exploded perspective view of the present invention according to the preferred embodiment.
Figure 4:
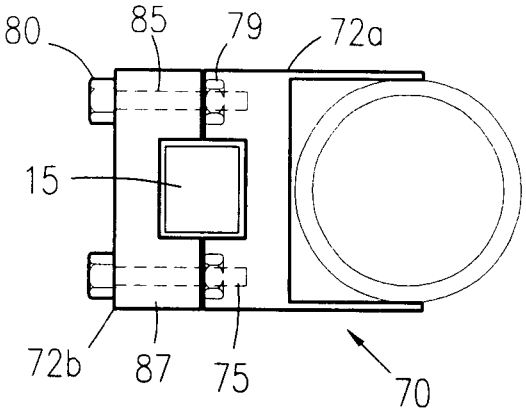
FIG. 4 is a top plan view of the mounting bracket shown mounted to a golf cart roof support member according to the preferred embodiment of the present invention.
Figure 5:
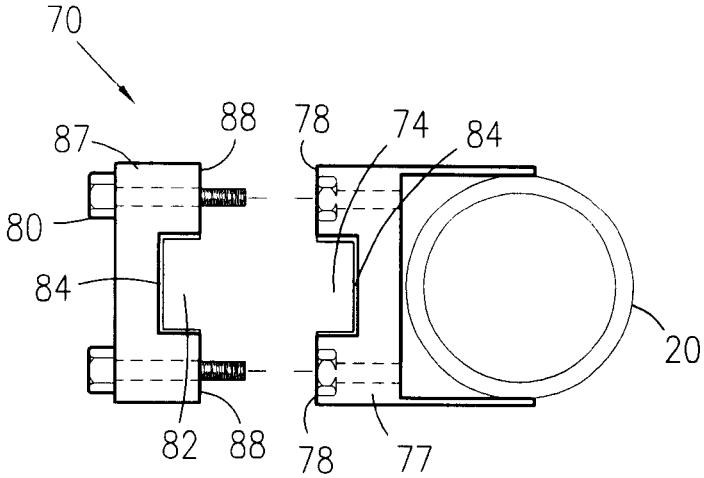
FIG. 5 is an exploded perspective view of the mounting bracket according to the preferred embodiment of the present invention.

Referring now in greater detail to FIGS. 2 and 3, the anterior end 22 of the tubular housing 20 includes a rim 41 defining an inlet opening 40 which provides entrance to the internal chamber 25.

A top cap 50 is provided which is generally of a circular configuration, and adapted so as to be received by the anterior end 22 of the tubular housing 20. The top cap 50 is defined as having a generally cylindrical lower sidewall 52, recessed below a vertical, generally cylindrical upper sidewall 54. A circular knob 56 is mounted centrally to an upper surface of the upper sidewall 54 so as to provide a gripping means for removing and securing the top cap 50 within the anterior end 22 of the tubular housing 20. The lower sidewall 52 has a pair of integrally formed, opposed locking projections 58 of a size suitable for being received within opposed L-shaped bayonet slots 60. The L-shaped slots 60 are molded integral with the outer side wall structure 21 of the tubular housing 20.

Restricting ribs 62, also molded integral with the outer side wall structure 21, are provided along a lower, wider portion of each L-shaped slot 60.

In order to secure the top cap 50 to the anterior end 22 of the tubular housing 20, the locking projections 58 are positioned so as to be at bottom portions of each L-shaped slot 60, and a lower surface of the upper sidewall 54 of the top cap 50 is abutted against the rim 41 of the tubular housing 20. The top cap 50 is slightly rotated in a clockwise direction, thereby passing the locking projections 58 over the restricting ribs 62 and into undercut portions 64 of the Lshaped slots 60, so as to effectively and securably retain the top cap 50 within the anterior end 22 of the tubular housing 20.

In order to remove the top cap 50, the top cap 50 is rotated in a counterclockwise direction, passing over the restricting ribs 62, so as to align the locking projections 58 with vertical portions of the L-shaped slots 60. The top cap 50 is then simply pulled upward and slidably removed from the anterior end 22 of the tubular housing 20.

Referring now to FIGS. 1, 3, 4, and 5, a mounting bracket 70 is provided and is adapted for mounting the tubular housing 20 to a golf cart roof support member 15. The mounting bracket 70 is comprised of a first mounting element 72*a* preferably molded in integral assembly with the tubular housing 20, along an upper portion of the outer sidewall structure 21, surrounding a rear sidewall, and to opposed sidewalls thereof, a short distance below the L-shaped slots 60. The first mounting element 72*a* defines a semi-rectangular void 74, which is defined by inner sidewalls lined with a thin layer of pliable rubber material 84. Apertures 75 are formed within opposing arms 77 of the first mounting element 72*a*. Nuts 79 are provided in a countersunk fashion within each aperture 75 for threadably receiving bolts 80 therethrough. Each arm 77 is provided with an elongated outer, flat, rectangular endwall 78.

A second mounting element 72*b*, generally of a C-shaped configuration, has a semi-rectangular void 82 defined by inner sidewalls lined with a thin layer of pliable rubber material 84. The second mounting element 72*b* includes threaded apertures 85 formed Within opposing arms 87 thereof. Each arm 87 is provided with an elongated outer, flat, rectangular endwall 88. The rubber material 84 lining the inner sidewalls of the first and second mounting elements 72*a*, 72*b* serves to aid in reducing shock forces received by the tubular housing 20 when mounted to a golf cart roof support member 15 and during such times when the golf cart is in transit and encounters changes in grade.

In order to mount the tubular housing 20 to a golf cart roof support member 15, the first mounting element 72*a* and the second mounting element 72*b* are abuttingly placed, endwalls 78 to endwalls 88 around a perimeter of the golf cart roof support member 15 along a desired height thereof. Bolts 80 are threadably inserted in the apertures 85 formed in the second mounting element 72*b* and continue through to the nuts 79 in the apertures 75 formed in the first mounting element 72*a*, and then tightened so as to removably mount the tubular housing 20 to the golf cart roof support member 15. The mounting bracket 70, in effect, circumscribes the perimeter of a golf cart roof support member 15 at a desired height, and is securely mounted therearound in an easy, quick, and efficient manner.

Rather than being molded in integral assembly with the tubular housing 20, it is envisioned that the first mounting element 72*a* may be, in the alternative, mounted along the upper portion of the outer sidewall structure 21, surrounding a rear sidewall, and opposed sidewalls thereof, a short distance below the L-shaped slot 60 by rivets or other suitable mounting means.

A mounting bracket 70 adapted so as to be removably mounted to a golf cart roof or a pull-cart handle is envisioned, wherein such mounting bracket 70 would be designed and configured so as not to depart from the spirit or scope of the present invention, but merely by mounting location.

Figure 6:
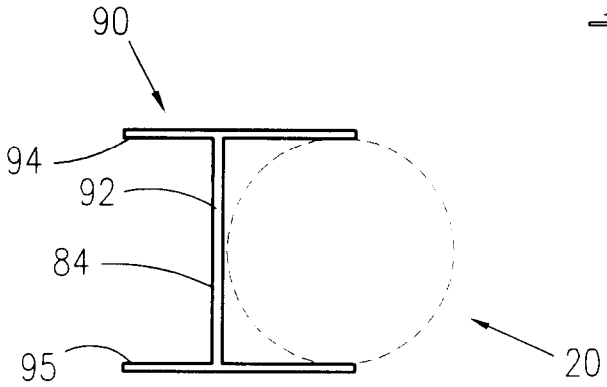
FIG. 6 is a top plan view of the housing alignment support according to the preferred embodiment of the present invention.
Figure 7A:
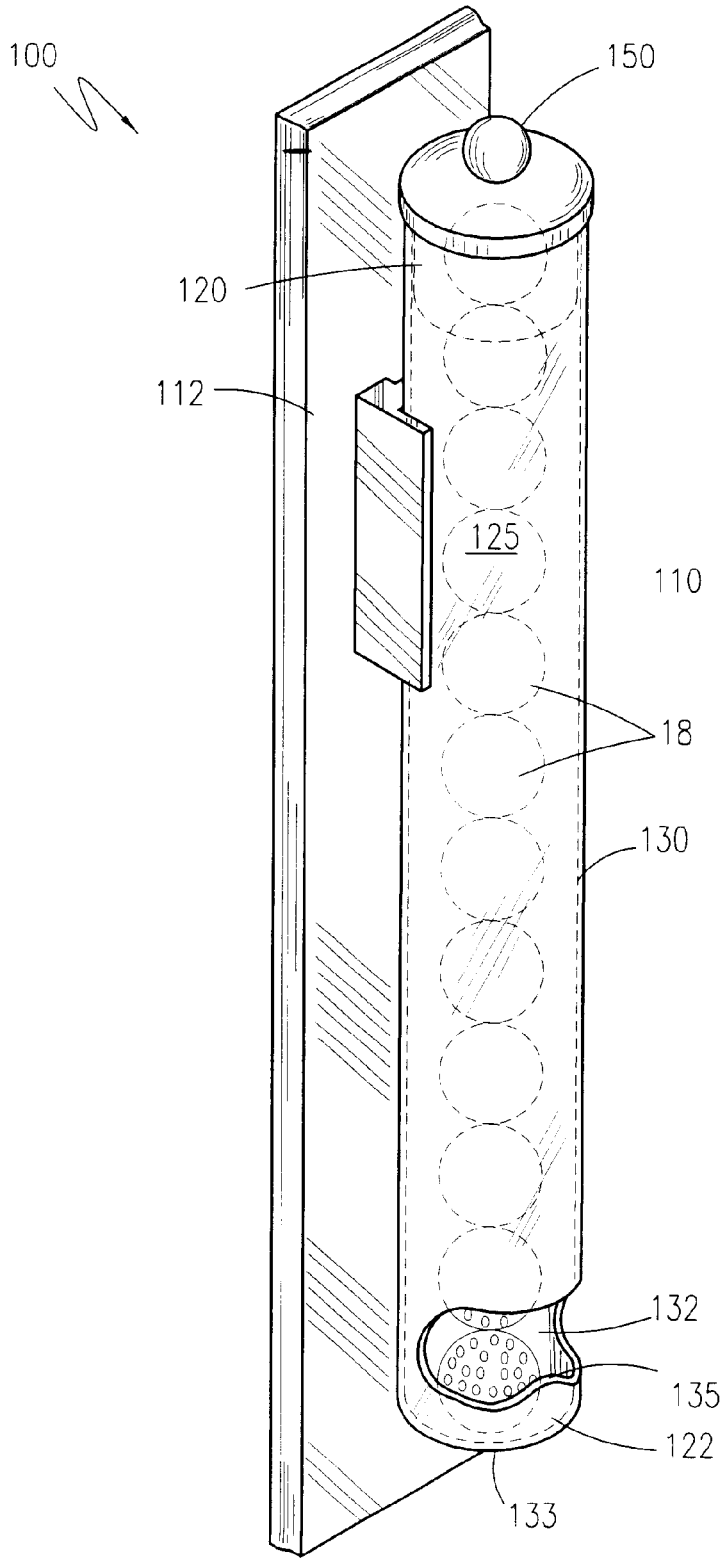
FIGS. 7*a*–7*d* show an alternate embodiment of the present invention.
Figure 7B:
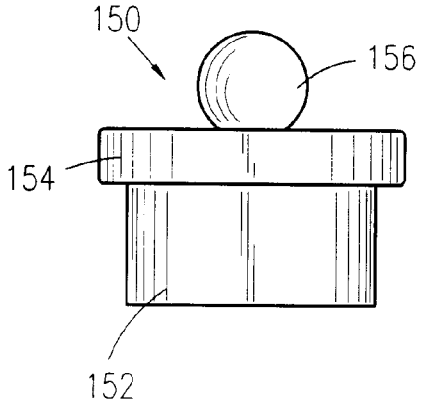
Figure 7C:
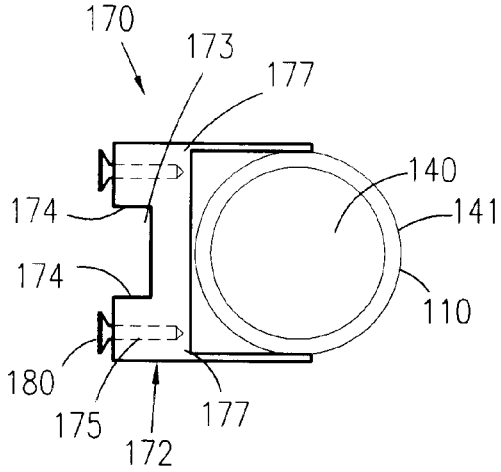
Figure 7D:
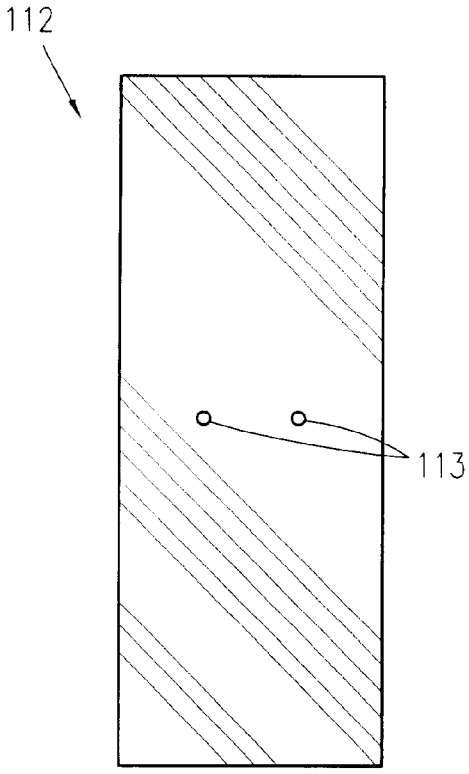

Referring now to FIGS. 1 and 6, a housing alignment support 90 is provided for aiding in maintaining proper linearly aligned contact with an external circumferential surface of a golf cart roof support member. The housing alignment support 90 is generally of an H-shaped configuration, preferably molded with the tubular housing 20, along a lower portion of the outer sidewall structure 21, below the second mounting element 72*b* of the mounting bracket 70. The housing alignment support 90 is further defined with a rectangular, intermediate wall 92 positioned perpendicularly between a pair of endwalls 94, 95. Inner portions of the intermediate wall 92 and the endwalls 94, 95 are lined with the thin layer of pliable rubber material 84. The inner portions of the intermediate wall 92 and the endwalls 94, 95 of the housing support are designed and configured so as to be in physical contact with the external circumferential surface of the golf cart roof support member 15, thereby not only aiding in maintaining the tubular housing 20 in proper linear alignment with respect therewith, but also preventing reciprocative movement thereof.

Referring now to FIGS. 1–6, when properly mounted, the present invention provides a portable golf ball storage and dispensing apparatus for golf balls 18 to be dispensed singly upon a user inserting fingers through the dispensing opening 32, and manually engaging the lowermost serially aligned golf ball 18 within the internal chamber. 25. The user then simultaneously applies a sufficient upward and transverse force so as to move the golf ball 18 over the restraining lip 35 and through the dispensing opening 32.

Thus, the present invention provides not only a means for storing golf balls 18, but also provides a means for dispensing a single golf ball 18 at a time.

Referring now to FIGS. 7*a–7d,* an alternate embodiment of the present invention is provided, wherein a wall-mounted presentation plaque 100 is shown, comprised of a linearly elongated, tubular housing 110 mounted preferably to a wooden plaque 112, of the type commonly utilized for displaying awards, victories, championships, and the like.

The tubular housing 110 is preferably constructed of a rigid, transparent plastic material such as acrylic, and has a uniform diameter which is slightly larger than a diameter of a golf ball 18. The tubular housing 110 is defined as having an anterior end 120 opposite a posterior end 122, an outer side wall structure 125 and an internal chamber 130. The alternate embodiment is designed and configured so as to provide a wall-mounted ornamental presentation, wherein a plurality of golf balls 18 are vertically aligned in series within the internal chamber 130 of the tubular housing 110. It is envisioned that the tubular housing 110 is of a length suitable for storing up to twelve golf balls 18.

A lower, front portion of the tubular housing 110 is formed to define a dispensing opening 132, wherein a lower extremity 133 thereof is formed of an upstanding arcuate-shaped restraining lip 135 for restraining transverse movement of a lowermost serially aligned golf ball 18 within the internal chamber 130.

The anterior end 120 of the tubular housing 110 includes a rim 141 defining an inlet opening 140 which provides entrance to the internal chamber 130.

A top cap 150 is provided which is generally of a circular configuration, and adapted so as to be slidably received within the anterior end 120 of the tubular housing 110 in a snug fitting manner. The top cap 150 is defined as having a generally cylindrical lower sidewall 152, recessed below a vertical, generally cylindrical upper sidewall 154. A circular knob 156 is mounted centrally to an upper surface of the upper sidewall 154 so as to provide a gripping means for removing and securing the top cap 150 within the anterior end 120 of the tubular housing 110.

A mounting bracket 170 is provided and is adapted for mounting the tubular housing 110 to a front surface of a wooden plaque 112. The mounting bracket 170 is comprised of a mounting element 172 preferably molded in integral assembly with the tubular housing 110, along a linearly elongated centerline of a rear side of the outer sidewall structure 125. The mounting element 172 defines a semi-rectangular void 173, which is defined by inner sidewalls 174. Threaded apertures 175 are formed within opposing arms 177 of the mounting element 172 for threadably receiving screws 180 therethrough.

In order to mount the tubular housing 110 to a front surface of a wooden plaque 112, screws 180 are inserted through threaded apertures 113 formed along a linearly elongated centerline of the wooden plaque 112, and extend through and threadably engage corresponding threaded apertures 175 in the arms 177 of the mounting element 172. The screws 180 are tightened so as to securely mount the tubular housing 110 to the front surface of the wooden plaque 112. The wall-mounted presentation plaque 100 is then suitably mounted to a wall, door, or other desired location for display.

After being properly mounted, the alternate embodiment allows the serially aligned golf balls 18 to be dispensed singly upon a user inserting fingers through the dispensing opening 132, and manually engaging the lowermost serially aligned golf ball 18 within the internal chamber 130. The user then simultaneously applies a sufficient upward and transverse force so as to move the golf ball 18 over the dispensing opening 132. Any golf balls 18 which have been removed can be simply reinserted back into the tubular housing 110 by removing the top cap 150 and inserting the golf ball 18 through the inlet opening 140 and into the internal chamber 130.

2. Operation of the Preferred Embodiment

To use the present invention, after being properly mounted to a golf cart roof support member 15, the user inserts desired golf balls 18 through the insert opening 40 and into the internal chamber 25 wherein the balls 18 are vertically aligned in series. The user then inserts the top cap 50 within the anterior end 22 of the tubular housing, and slightly rotates the top cap 50 in a clockwise direction, thereby passing the locking projections 58 over the restricting ribs 62 and into undercut portions 64 of the L-shaped slots 60, so as to effectively and securably retain the top cap 50 within the anterior end 22 of the tubular housing 20.

In the event the user desires to remove the top cap 50, the user rotates the top cap 50 in a counterclockwise direction, passing over the restricting ribs 62, so as to align the locking projections 58 with vertical portions of the L-shaped slots 60. The user then simply pulls the top cap 50 upward and slidably removes it from the anterior end 22 of the tubular housing 20.

In the event the user desires to dispense a single golf ball 18, the user inserts fingers through the dispensing opening 32, and manually engages the lowermost serially aligned golf ball 18 within the internal chamber 25. The user then simultaneously applies a sufficient upward and transverse force so as to move the golf ball 18 over the restraining lip 35 and through the dispensing opening 32.

The use of the present invention allows golf balls to be stored and easily accessed during practice or during a round of golf, and can also be displayed as a wall-mounted plaque in a quick, easy, and efficient manner.

Therefore, the foregoing description is included to illustrate the operation of the preferred embodiment and is not meant to limit the scope of the invention. As one can envision, an individual skilled in the relevant art, in conjunction with the present teachings, would be capable of incorporating many minor modifications that are anticipated within this disclosure. Therefore, the scope of the invention is to be broadly limited only by the following claims.

What is claimed is:

1. A portable golf ball storage, dispensing and display apparatus comprising:

a linearly elongated tubular housing having a uniform diameter which is slightly larger than a diameter of a golf ball;

a mounting bracket; and a housing alignment support for affixing and aligning said bracket to and with said housing.

2. The portable golf ball storage, dispensing and display apparatus of claim 1, wherein said tubular housing is constructed of a rigid, transparent material.

3. The portable golf ball storage, dispensing and display apparatus of claim 1, wherein said tubular housing is further defined as having an anterior end opposite a posterior end, wherein a portion of the tubular housing above the posterior end is curved slightly inward.

4. The portable golf ball storage, dispensing and display apparatus of claim 3, wherein said tubular housing includes an outer side wall structure and an internal chamber, wherein a plurality of golf balls can be vertically aligned in series within said internal chamber.

5. The portable golf ball storage, dispensing and display apparatus of claim 4, wherein a lower, front portion of said tubular housing is formed to define a dispensing opening, wherein a lower extremity thereof is formed of an upstanding arcuate-shaped restraining lip for restraining transverse movement of a lowermost serially aligned golf ball within the internal chamber.

6. The portable golf ball storage, dispensing and display apparatus of claim 5, wherein said anterior end of said tubular housing includes a rim defining an inlet opening which provides entrance to said internal chamber.

7. The portable golf ball storage, dispensing and display apparatus of claim 6, further comprising a top cap of a generally of a circular configuration, and adapted so as to be received by said anterior end of said tubular housing.

8. The portable golf ball storage, dispensing and display apparatus of claim 7, wherein said top cap is defined as having a generally cylindrical lower sidewall recessed below a vertical, generally cylindrical upper sidewall.

9. The portable golf ball storage, dispensing and display apparatus of claim 8, further comprising a circular knob mounted centrally to an upper surface of said upper sidewall so as to provide a gripping means for removing and securing said top cap within said anterior end of said tubular housing.

10. The portable golf ball storage, dispensing and display apparatus of claim 3, wherein said lower sidewall has a pair of integrally formed, opposed locking projections of a size suitable for being received within opposed L-shaped bayonet slots; and wherein said L-shaped slots are molded integral with said outer side wall structure of said tubular housing.

11. The portable golf ball storage, dispensing and display apparatus of claim 1, wherein said mounting bracket is provided and is adapted for mounting said tubular housing to a golf cart roof support member and said mounting bracket is comprised of a first mounting element molded in integral assembly with said tubular housing along an upper portion of said outer sidewall structure, surrounding a rear sidewall, and opposed sidewalls thereof.

12. The portable golf ball storage, dispensing and display apparatus of claim 11, wherein said first mounting element defines a semi-rectangular void which is defined by inner sidewalls lined with a thin layer of pliable rubber material.

13. The portable golf ball storage, dispensing and display apparatus of claim 12, wherein said apertures are formed within opposing arms of said first mounting element.

14. The portable golf ball storage, dispensing and display apparatus of claim 13, wherein said tubular housing is mountable to a golf cart roof support member via said first mounting element and a second mounting element abuttingly placed, endwall to endwall around a perimeter of the golf cart roof support member along a desired height thereof.

15. The portable golf ball storage, dispensing and display apparatus of claim 1, wherein said housing alignment support is provided for aiding in maintaining proper linearly aligned contact with an external circumferential surface of a golf cart roof support member and is of an H-shaped configuration incorporated within said tubular housing along a lower portion of the outer sidewall structure.

* * * * *